US011976895B2

(12) United States Patent
Sawada

(10) Patent No.: US 11,976,895 B2
(45) Date of Patent: May 7, 2024

(54) PLATE HEAT EXCHANGER AND HEAT PUMP APPARATUS INCLUDING THE SAME

(71) Applicant: Mitsubishi Electric Corporation, Tokyo (JP)

(72) Inventor: Kazunari Sawada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 406 days.

(21) Appl. No.: 17/422,905

(22) PCT Filed: Mar. 18, 2019

(86) PCT No.: PCT/JP2019/011120
§ 371 (c)(1),
(2) Date: Jul. 14, 2021

(87) PCT Pub. No.: WO2020/188690
PCT Pub. Date: Sep. 24, 2020

(65) Prior Publication Data

US 2022/0120519 A1 Apr. 21, 2022

(51) Int. Cl.

| | |
|---|---|
| ***F28F 9/02*** | (2006.01) |
| ***F28D 9/00*** | (2006.01) |
| *F28F 3/04* | (2006.01) |

(52) U.S. Cl.
CPC ..... *F28F 9/0221* (2013.01); *F28D 9/0037* (2013.01); *F28F 3/04* (2013.01); *F28F 2235/00* (2013.01); *F28F 2275/04* (2013.01)

(58) Field of Classification Search
CPC .... F28F 9/0221; F28F 9/0037; F28F 2235/00; F28F 2275/04; F28F 3/04; F28D 3/04; F28D 9/0037
See application file for complete search history.

(56) References Cited

U.S. PATENT DOCUMENTS 5,178,207 A * 1/1993 Bergqvist ..... F28F 3/005 165/70
5,291,945 A * 3/1994 Blomgren ..... B23K 1/0012 165/166

(Continued)

FOREIGN PATENT DOCUMENTS

DE 197 57 803 A1 7/1999
JP H06-039251 Y2 10/1994

(Continued)

OTHER PUBLICATIONS

Merriam Webster definition of "flange." (Year: 2023).*

(Continued)

*Primary Examiner* — Marc E Norman
(74) *Attorney, Agent, or Firm* — POSZ LAW GROUP, PLC

(57) ABSTRACT

When, out of adjacent two in a stacking direction of heat transfer plates, one heat transfer plate provided in front of the other heat transfer plate is referred to as a first heat transfer plate and the other heat transfer plate provided in rear of the one heat transfer plate is referred to as a second heat transfer plate, a header portion of each of the first heat transfer plates and a corresponding header portion of each of the second heat transfer plates partly form a non-flow path region where the header portions are in contact with each other not to allow fluid to pass through the non-flow path region. A peripheral edge part in the non-flow path region of each of the first heat transfer plates includes a convex portion projecting upward, and a peripheral edge part in the non-flow path region of each of the second heat transfer plates includes a concave portion recessed downward. A space of the convex portion and a space of the concave portion are stacked on each other in the stacking direction to define a cavity, and a communication port through which the (Continued)

cavity communicates with outside is provided at plate portions defining the cavity.

7 Claims, 12 Drawing Sheets

(56) References Cited

U.S. PATENT DOCUMENTS

| | | | | |
|---|---|---|---|---|
| 6,973,961 | B2 * | 12/2005 | Rehberg | F28F 3/046 165/70 |
| 9,091,494 | B2 * | 7/2015 | Dahlberg | F28F 17/005 |
| 9,874,409 | B2 | 1/2018 | Ito | |
| 2003/0201094 | A1 | 10/2003 | Evans et al. | |
| 2007/0169916 | A1 | 7/2007 | Wand et al. | |
| 2012/0267084 | A1 * | 10/2012 | Crawford | F28F 3/005 165/170 |

FOREIGN PATENT DOCUMENTS

| | | | |
|---|---|---|---|
| JP | 2005-524042 | A | 8/2005 |
| JP | 2007-192534 | A | 8/2007 |
| JP | 2014-214934 | A | 11/2014 |
| JP | 5805189 | B2 | 11/2015 |
| KR | 10-1952938 | B1 | 2/2019 |

OTHER PUBLICATIONS

International Search Report of the International Searching Authority dated Jun. 4, 2019 for the corresponding International application No. PCT/JP2019/011120 (and English translation).

Office Action dated Mar. 2, 2023 issued in corresponding DE patent application No. 112019007056.8 (and English translation).

* cited by examiner

PLATE HEAT EXCHANGER AND HEAT PUMP APPARATUS INCLUDING THE SAME

CROSS REFERENCE TO RELATED APPLICATION

This application is a U.S. national stage application of PCT/JP2019/011120 filed on Mar. 18, 2019, the contents of which are incorporated herein by reference.

TECHNICAL FIELD

The present disclosure relates to a plate heat exchanger in which a plurality of heat transfer plates are stacked on each other, and to a heat pump apparatus including the plate heat exchanger.

BACKGROUND ART

A plate heat exchanger through which two different flows of fluid exchange heat with each other has a configuration in which a plurality of heat transfer plates are stacked on each other, first flow paths and second flow paths are alternately provided among the heat transfer plates, and heat is exchanged between water flowing through the first flow paths and refrigerant flowing through the second flow paths.

In a case where this type of plate heat exchanger is used as an evaporator, there is an issue that the water freezes inside the plate heat exchanger, and the plate heat exchanger is damaged by expansion of the water because of freezing. A technique preventing such damage of the plate heat exchanger caused by freezing has been proposed (for example, see Patent Literature 1).

CITATION LIST

Patent Literature

Patent Literature 1: Japanese Patent No. 5805189

SUMMARY OF INVENTION

Technical Problem

In the plate heat exchanger, reinforcing concave-convex shapes are provided on each of the heat transfer plates to prevent distortion of the heat transfer plates caused by internal pressure among the heat transfer plates. More specifically, a reinforcing convex portion is provided on a first heat transfer plate, and a concave portion is provided on a second heat transfer plate that is stacked on a surface of the first heat transfer plate on which the convex portion is provided. A top surface of the convex portion and a bottom surface of the concave portion are into contact with each other, and are brazed to each other to reinforce the heat transfer plates.

First heat transfer plates and second heat transfer plates are alternately stacked on each other. Therefore, each of the first heat transfer plates is stacked on a surface of a corresponding one of the second heat transfer plates from which an opening of the concave portion faces upward. When the convex portion of the first heat transfer plate and the concave portion of the second heat transfer plate are stacked on each other in a stacking direction, a cavity is defined, and surroundings of the cavity are brazed to each other and sealed. However, when a brazing failure is present at the surroundings of the cavity, water flowing through a flow path flows into and stays in the cavity, and the water inside the cavity freezes to damage the heat transfer plates.

The brazing failure does not have an effect on original functions of the heat transfer plates such as heat transfer performance, static strength, and strength with time, and is difficult to be detected in a manufacturing stage. If a possible brazing failure is detected before shipment of a product, it will be possible to avoid damage caused by freezing, which is extremely effective. The technique disclosed in Patent Literature 1 is a technique to prevent damage of the plate heat exchanger caused by freezing, but is targeted at a regularly-finished product in which brazing is normally performed, and cannot detect freezing caused by brazing failure.

The present disclosure is made in consideration of such circumstances, and an object of the present disclosure is to provide a plate heat exchanger that enables detection of brazing failure before shipment, and to provide a heat pump apparatus including the plate heat exchanger.

Solution to Problem

A plate heat exchanger according to an embodiment of the present disclosure is a plate heat exchanger having flow paths formed by spaces among a plurality of heat transfer plates stacked on each other. When, out of adjacent two in a stacking direction of the plurality of heat transfer plates, one heat transfer plate provided in front of the other heat transfer plate is referred to as a first heat transfer plate and the other heat transfer plate provided in rear of the one heat transfer plate is referred to as a second heat transfer plate, the first heat transfer plates and the second heat transfer plates are alternately stacked on each other. Each of the first heat transfer plates and the second heat transfer plates includes a heat exchange portion and header portions. Fluid flowing through the flow paths exchanges heat through the heat exchange portion. The header portions are provided on respective ends of the heat exchange portion in a flowing direction of the fluid. A header portion of each of the first heat transfer plates and a corresponding header portion of each of the second heat transfer plates partly form a non-flow path region where the header portions are in contact with each other not to allow the fluid to pass through the non-flow path region. A peripheral edge part in the non-flow path region of each of the first heat transfer plates includes a convex portion projecting upward. A peripheral edge part in the non-flow path region of each of the second heat transfer plates includes a concave portion recessed downward. A space of the convex portion of each of the first heat transfer plates and a space of the concave portion of a corresponding one of the second heat transfer plates are stacked on each other in the stacking direction to define a cavity, and a communication port through which the cavity communicates with outside is provided at plate portions defining the cavity.

Advantageous Effects of Invention

According to an embodiment of the present disclosure, the cavity defined in the non-flow path region communicates with the outside through the communication port. Therefore, in a case where the cavity communicates with the heat exchange portion because of brazing failure, inspection air leaks from the communication port in airtightness inspection before shipment, which enables detection of the brazing failure.

DESCRIPTION OF EMBODIMENTS

Embodiment 1

A basic configuration of a plate heat exchanger 40 according to Embodiment 1 is described.

Figure 1:
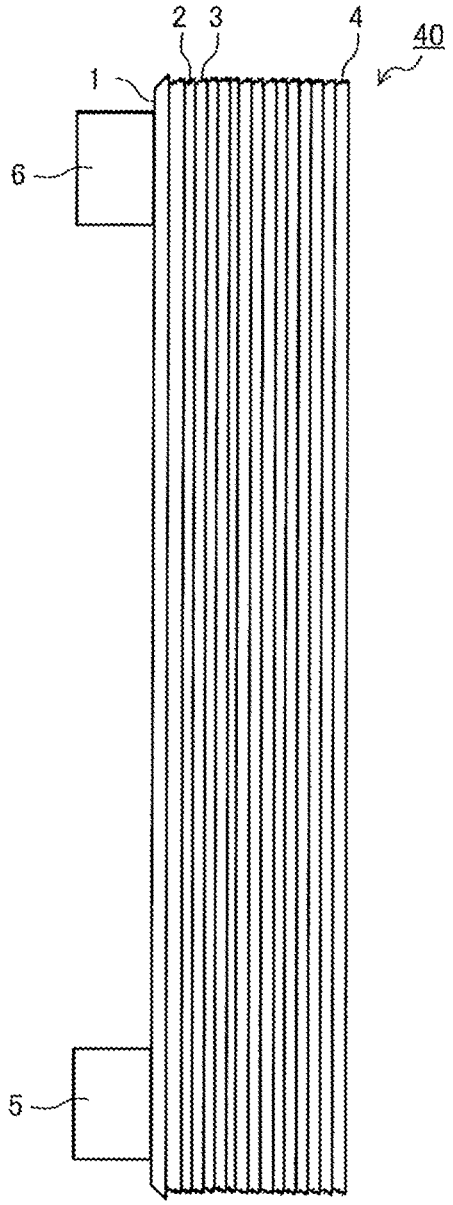
FIG. 1 is a side view of a plate heat exchanger 40 according to Embodiment 1 of the present disclosure.
Figure 2:
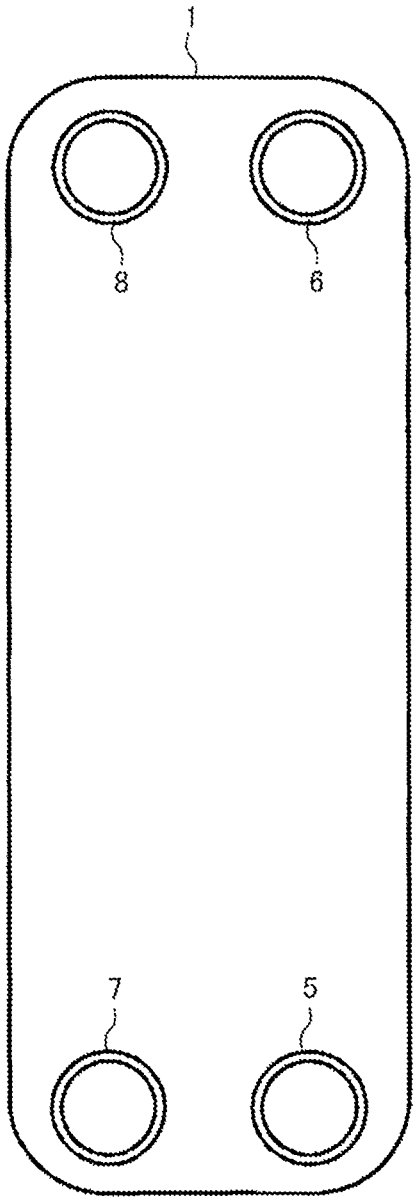
FIG. 2 is a front view of a reinforcing side plate 4 of the plate heat exchanger 40 according to Embodiment 1 of the present disclosure.
Figure 3:
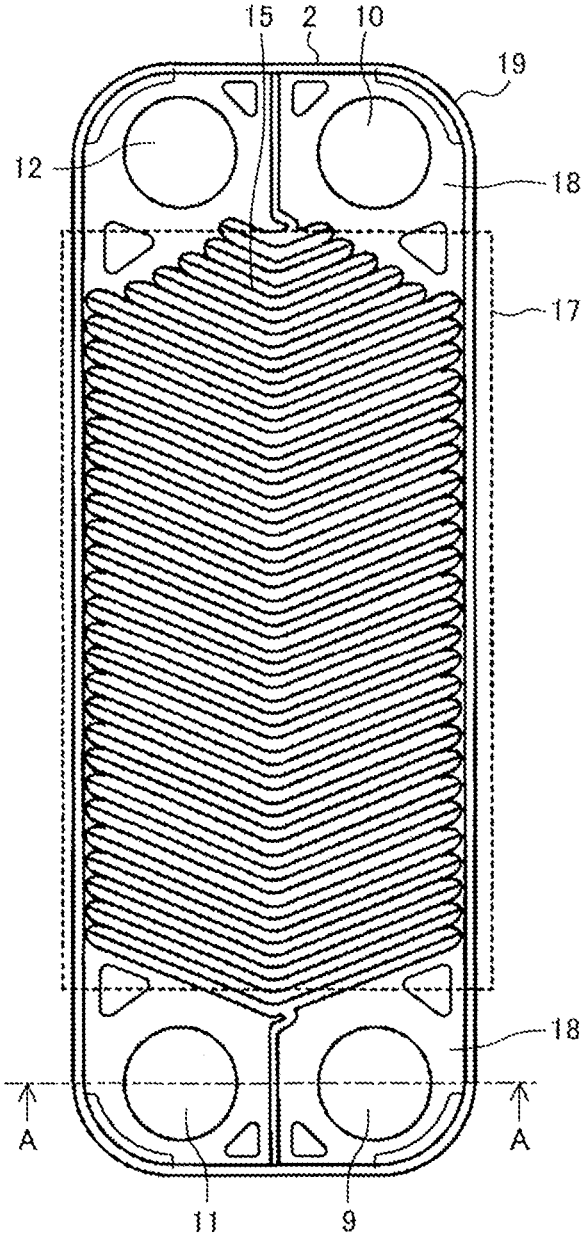
FIG. 3 is a front view of a heat transfer plate 2 of the plate heat exchanger 40 according to Embodiment 1 of the present disclosure.
Figure 4:
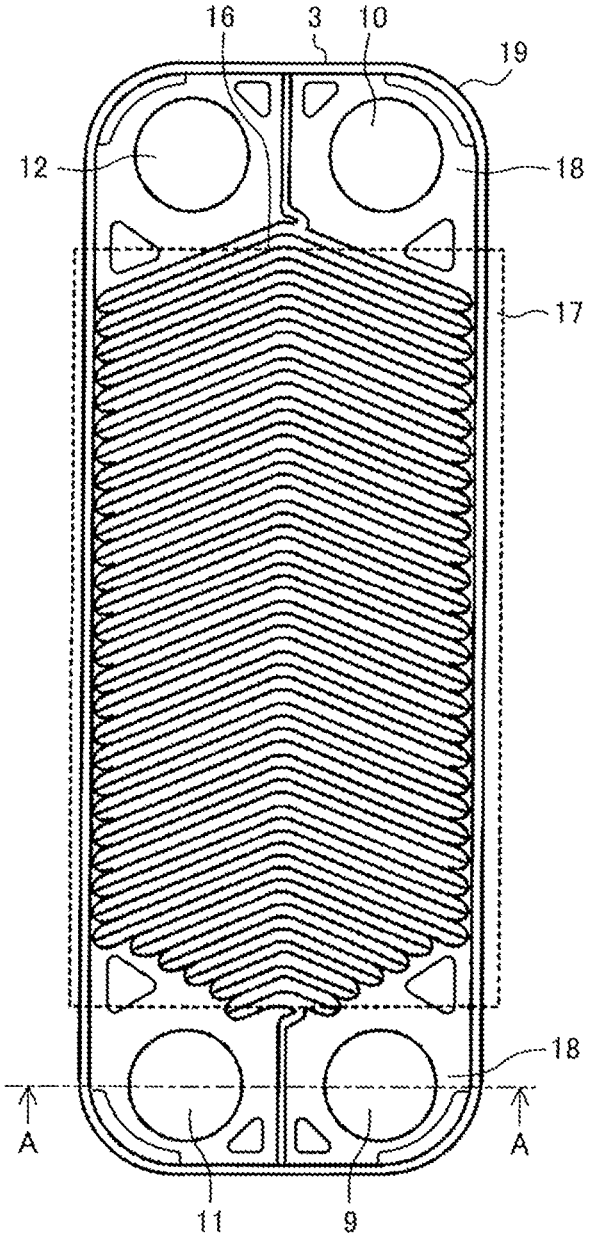
FIG. 4 is a front view of a heat transfer plate 3 of the plate heat exchanger 40 according to Embodiment 1 of the present disclosure.
Figure 5:
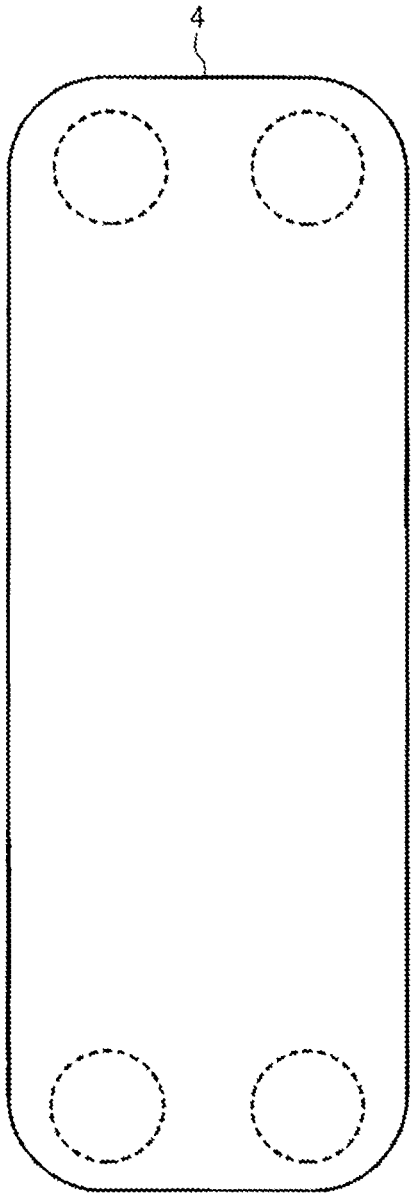
FIG. 5 is a front view of a reinforcing side plate 4 of the plate heat exchanger 40 according to Embodiment 1 of the present disclosure.
Figure 6:
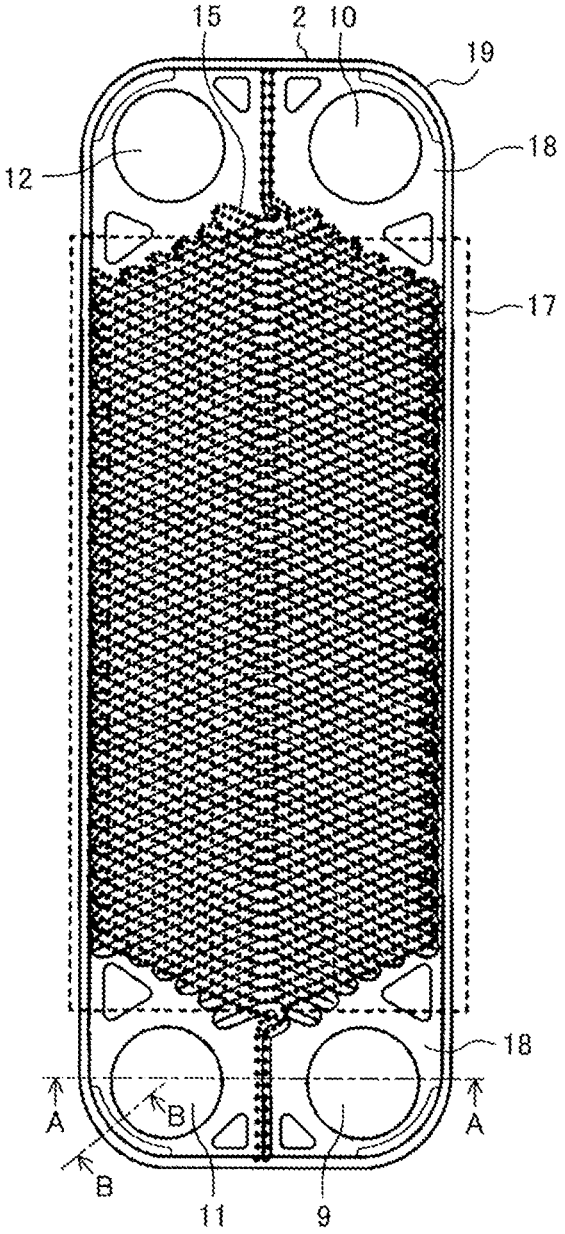
FIG. 6 is a diagram to explain a state where the heat transfer plate 2 and the heat transfer plate 3 of the plate heat exchanger 40 are stacked on each other, according to Embodiment 1 of the present disclosure.
Figure 7:
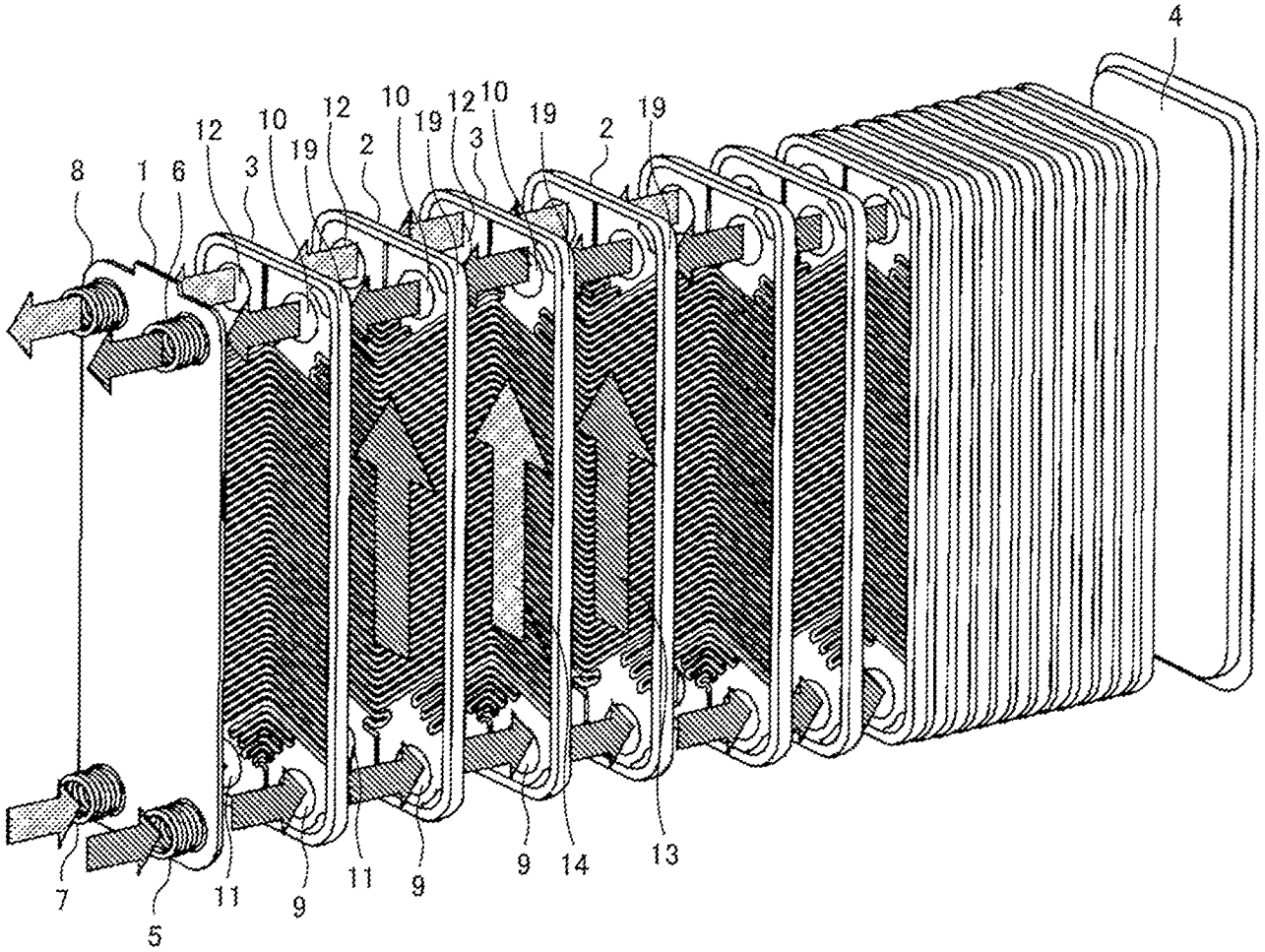
FIG. 7 is an exploded perspective view of the plate heat exchanger 40 according to Embodiment 1 of the present disclosure.

FIG. 1 is a side view of the plate heat exchanger 40 according to Embodiment 1 of the present disclosure. FIG. 2 is a front view of a reinforcing side plate 4 of the plate heat exchanger 40 according to Embodiment 1 of the present disclosure. FIG. 3 is a front view of a heat transfer plate 2 of the plate heat exchanger 40 according to Embodiment 1 of the present disclosure. FIG. 4 is a front view of a heat transfer plate 3 of the plate heat exchanger 40 according to Embodiment 1 of the present disclosure. FIG. 5 is a front view of a reinforcing side plate 4 of the plate heat exchanger 40 according to Embodiment 1 of the present disclosure. FIG. 6 is a diagram to explain a state where the heat transfer plate 2 and the heat transfer plate 3 of the plate heat exchanger 40 are stacked on each other, according to Embodiment 1 of the present disclosure. FIG. 7 is an exploded perspective view of the plate heat exchanger 40 according to Embodiment 1 of the present disclosure.

As illustrated in FIG. 1, in the plate heat exchanger 40, the heat transfer plates 2 and the heat transfer plates 3 are alternately stacked on each other. Further, in the plate heat exchanger 40, the reinforcing side plate 1 is stacked on a frontmost surface, and the reinforcing side plate 4 is stacked on a rearmost surface.

As illustrated in FIG. 2, the reinforcing side plate 1 is formed in a substantially rectangular plate shape. The reinforcing side plate 1 includes a first inflow pipe 5, a first outflow pipe 6, a second inflow pipe 7, and a second outflow pipe 8 at four respective corners of the substantially rectangular shape. As illustrated in FIG. 3 and FIG. 4, each of the heat transfer plates 2 and the heat transfer plates 3 is formed in a substantially rectangular plate shape as with the reinforcing side plate 1, and includes a first inflow port 9, a first outflow port 10, a second inflow port 11, and a second outflow port 12 at four respective corners.

Each of the heat transfer plates 2 includes a corrugated portion 15 having a corrugated concave-convex shape, and each of the heat transfer plates 3 includes a corrugated portion 16 having a corrugated concave-convex shape. As viewed from a stacking direction, the corrugated portion 15 is formed in a substantially V-shape. As viewed from the stacking direction, the corrugated portion 16 is formed in a substantially inverted V-shape. Each of the corrugated portion 15 and the corrugated portion 16 has a shape in which a convex portion and a concave portion repeatedly appear from the first inflow port 9 and the second inflow port 11 toward the first outflow port 10 and the second outflow port 12.

Each of the heat transfer plates 2 and the heat transfer plates 3 includes a heat exchange portion 17, header portions 18, and an outer peripheral flange portion 19. The heat exchange portion 17 is provided with the corrugated portion 15 or the corrugated portion 16, and fluid flowing through flow paths exchanges heat through the heat exchange portion 17. The header portions 18 are provided on respective ends of the heat exchange portion 17 in a fluid flowing direction. The first inflow port. 9, the first outflow port 10, the second inflow port 11, and the second outflow port 12 are provided in the header portions 18. The outer peripheral flange portion 19 extends from an outer peripheral edge of each heat transfer plate toward an outer peripheral edge of an adjacent heat transfer plate. In this example, the outer peripheral flange portion 19 extends from the outer peripheral edge of each of the heat transfer plates 2 and the heat transfer plates 3 toward the rear as illustrated in FIG. 7; however, the outer peripheral flange portion 19 may extend toward the front.

As illustrated in FIG. 5, the reinforcing side plate 4 is formed in a substantially rectangular plate shape as with the reinforcing side plate 1 and other plates. The first inflow pipe 5, the first outflow pipe 6, the second inflow pipe 7, and the second outflow pipe 8 are not provided in the reinforcing side plate 4. In FIG. 5, positions of the first inflow pipe 5, the first outflow pipe 6, the second inflow pipe 7, and the second outflow pipe 8 are illustrated by dashed lines for reference in the reinforcing side plate 4; however, these pipes are not actually provided in the reinforcing side plate 4. The first inflow pipe 5; the first outflow pipe 6, the second inflow pipe 7, and the second outflow pipe 8 are not necessarily provided in the reinforcing side plate 1, and may be provided in the reinforcing side plate 4. In this case; the first inflow pipe 5, the first outflow pipe 6, the second inflow pipe 7, and the second outflow pipe 8 are not provided in the reinforcing side plate 1. Further; the first inflow pipe 5, the first outflow pipe 6, the second inflow pipe 7, and the second outflow pipe 8 may not be collected in one of the reinforcing side plate 1 and the reinforcing side plate 4.

As illustrated in FIG. 6, one heat transfer plate 2 and one heat transfer plate 3 are stacked on each other, the corrugated portion 15 and the corrugated portion 16 having the substantially V-shapes different in direction face each other, and a flow path generating a complicated flow is accordingly formed between the heat transfer plate 2 and the heat transfer plate 3.

As illustrated in FIG. 7, the heat transfer plates 2 and the heat transfer plates 3 are stacked on each other such that the first inflow ports 9 face one another, the first outflow ports 10 face one another, the second inflow ports 11 face one another, and the second outflow ports 12 face one another. Further, the reinforcing side plate 1 and one of the heat transfer plates 2 are stacked on each other such that the first inflow pipe 5 and the first inflow port 9 face each other, the first outflow pipe 6 and the first outflow port 10 face one another, the second inflow pipe 7 and the second inflow port 11 face each other, and the second outflow pipe 8 and the second outflow port 12 face one another.

Further, the heat transfer plates 2 and the heat transfer plate 3 are stacked on each other such that the outer peripheral flange portions 19 face one another, and the reinforcing side plate 1 and the reinforcing side plate 1 are further stacked respectively on the front surface and the rear surface of a stacked body, and are joined by brazing or other method. In this state, the outer peripheral flange portions 19 of the heat transfer plates 2 and the heat transfer plates 3 face one another, and the portions facing one another are also joined. An outer peripheral edge of each of the reinforcing side plate 1 and the reinforcing side plate 1 is also joined with the adjacent heat transfer plate. In addition, a portion where, as viewed from the stacking direction, the concave portion of the corrugated portion of one heat transfer plate stacked on front of the other heat transfer plate of adjacent two of the heat transfer plates and the convex portion of the corrugated portion of the other heat transfer plate stacked on rear of the one heat transfer plate face each other is also joined.

As a result, a first flow path 13 through which first fluid having flowed from the first inflow pipe 5 flows out from the first outflow pipe 6 is formed between a rear surface of each of the heat transfer plates 3 and a front surface of a corresponding one of the heat transfer plates 2. Likewise, a second flow path 14 through which second fluid having flowed from the second inflow pipe 7 flows out from the second outflow pipe 8 is formed between a rear surface of each of the heat transfer plates 2 and a front surface of a corresponding one of the heat transfer plates 3. The first fluid having flowed from outside into the first inflow pipe 5 flows through a passage hole defined by the first inflow ports 9 of the heat transfer plates 2 and the heat transfer plates 3 that face one another, and flows into each of the first flow paths 13. The first fluid having flowed into each of the first flow paths 13 flows in a long-side direction while gradually spreading in a short-side direction, and flows out from each of the first outflow ports 10. The first fluid having flowed out from each of the first outflow ports 10 flows through a passage hole defined by the first outflow ports 10 facing one another, and flows out to outside from the first outflow pipe 6.

Likewise, the second fluid having flowed from outside into the second inflow pipe 7 flows through a passage hole defined by the second inflow ports 11 of the heat transfer plates 2 and the heat transfer plates 3 that face one another, and flows into each of the second flow paths 14. The second fluid having flowed into each of the second flow paths 14 flows in the long-side direction while gradually spreading in the short-side direction, and flows out from each of the second outflow ports 12. The second fluid having flowed out from each of the second outflow ports 12 flows through a passage hole defined by the second outflow ports 12 facing one another, and flows out to the outside from the second outflow pipe 8.

The first fluid flowing through the first flow paths 13 and the second fluid flowing through the second flow paths 14 exchange heat between each other via the heat transfer plates 2 and the heat transfer plates 3 when flowing through the heat exchange portions 17 provided with the corrugated portions 15 and the corrugated portions 16.

The first fluid is, for example, water. The second fluid is, for example, refrigerant such as $CO_2$, R410A, and HC.

Next, a configuration of the header portions 18 of the plate heat exchanger 40 according to Embodiment 1 is described.

Figure 8:
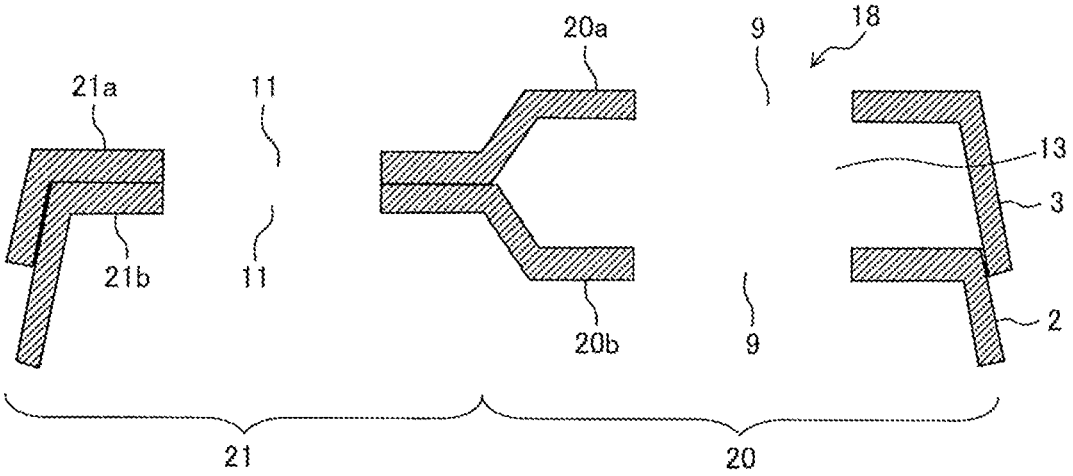
FIG. 8 is a cross-sectional view taken along line A-A illustrated in FIG. 6.
Figure 9:
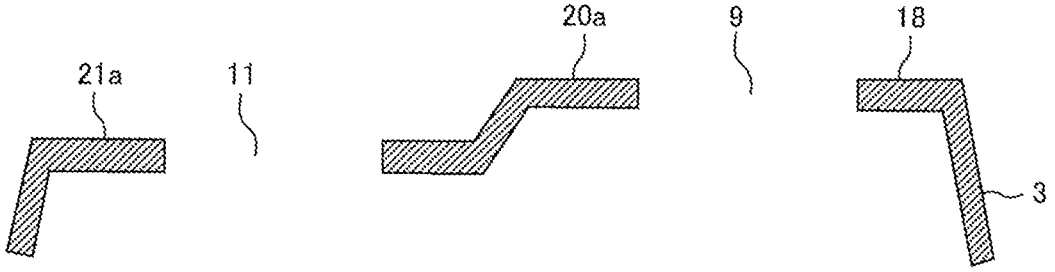
FIG. 9 is a cross-sectional view taken along line A-A illustrated in FIG. 4.
Figure 10:
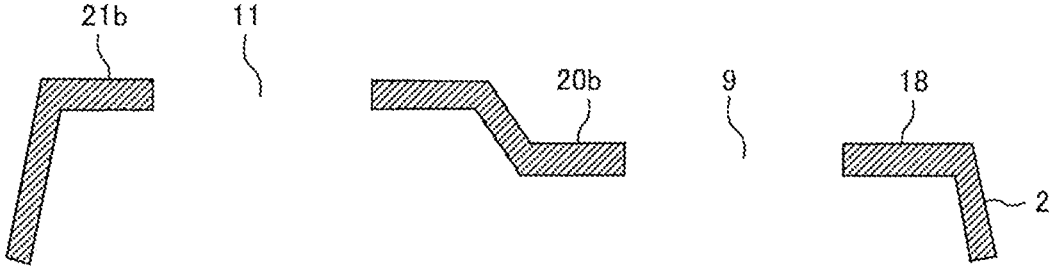
FIG. 10 is a cross-sectional view taken along line A-A illustrated in FIG. 3.

FIG. 8 is a cross-sectional view taken along line A-A illustrated in FIG. 6. FIG. 9 is a cross-sectional view taken along line A-A illustrated in FIG. 4. FIG. 10 is a cross-sectional view taken along line A-A illustrated in FIG. 3. In FIG. 8 to FIG. 10, the cross-sections taken along the lines A-A are at the same position.

The header portion 18 of each of the first heat transfer plates 3 and the header portion 18 of a corresponding one of the second heat transfer plates 2 form a flow path region 20 where the header portions 18 are separated from each other to allow the fluid to pass through the flow path region 20, and a non-flow path region 21 where the header portions 18 are in contact with each other not to allow the fluid to pass through the non-flow path region 21.

Specific configurations of the flow path region 20 and the non-flow path region 21 are described below.

As illustrated in FIG. 8 and FIG. 9, the header portion 18 of each first heat transfer plate 3 includes a convex region **20*a* provided with the first inflow port 9, and a concave region 21*a* provided with the second inflow port 11. Further, as illustrated in FIG. 8 and FIG. 10, the header portion 18 of each second heat transfer plate 2 also includes a concave region 20*b* provided with the first inflow port 9, and a convex region 21*b* provided with the second inflow port 11. The convex region 20*a* of the first heat transfer plate 3 projects upward, whereas the concave region 20*b* of the second heat transfer plate 2 is recessed downward. Therefore, the convex region 20*a* and the concave region 20*b* are separated from each other to form the flow path region 20 allowing the fluid to pass through the flow path region 20. The flow path region 20 forms a part of the first flow path 13 through which the first fluid flows. In other words, the first fluid having flowed from the first inflow port 9 passes through the flow path region 20, and then flows through the first flow path 13 between the heat exchange portion 17 of the first heat transfer plate 3 and the heat exchange portion 17 of the second heat transfer plate 2**.

On the other hand, the concave region 21*a* of the first heat transfer plate 3 is recessed downward, whereas the convex region 21*b* of the second heat transfer plate 2 projects upward. Therefore, the concave region 21*a* and the convex region 21*b* are contact with each other, and are brazed to each other to form the non-flow path region 21 not allowing the fluid to pass through the non-flow path region 21 in a surface direction of the heat transfer plates. The first fluid thus does not flow in the non-flow path region 21.

In this example, out of the header portions 18 provided at the respective end parts of each heat transfer plate in the longitudinal direction, the header portion 18 provided with the first inflow port 9 and the second inflow port 11 has been described; however, the header portion 18 provided with the first outflow port 10 and the second outflow port 12 has a similar configuration. In other words, the header portion 18 provided with the first outflow port 10 of each of the first heat transfer plates 3 and the header portion 18 provided with the first outflow port 10 of a corresponding one of the second heat transfer plates 2 form the flow path region 20 in a manner similar to the header portions 18 each provided with the first inflow port 9. Further, the header portion 18 provided with the second outflow port 12 of each of the first heat transfer plates 3 and the header portion 18 provided with the second outflow port 12 of a corresponding one of the second heat transfer plates 2 form the non-flow path region 21 in a manner similar to the header portions 18 each provided with the second inflow port 11.

When the plurality of first heat transfer plates 3 and the plurality of second heat transfer plates 2 having the above-described configuration are alternately stacked on each other, the flow paths through which the fluid flows from each first inflow port 9 to the corresponding first outflow port 10 and the flow paths through which the fluid flows from each second inflow port 11 to the corresponding second outflow port 12 are alternately formed among the heat transfer plates.

Next, the more detailed configuration of the header portions 18 of the plate heat exchanger 40 according to Embodiment 1 is described.

Figure 11:
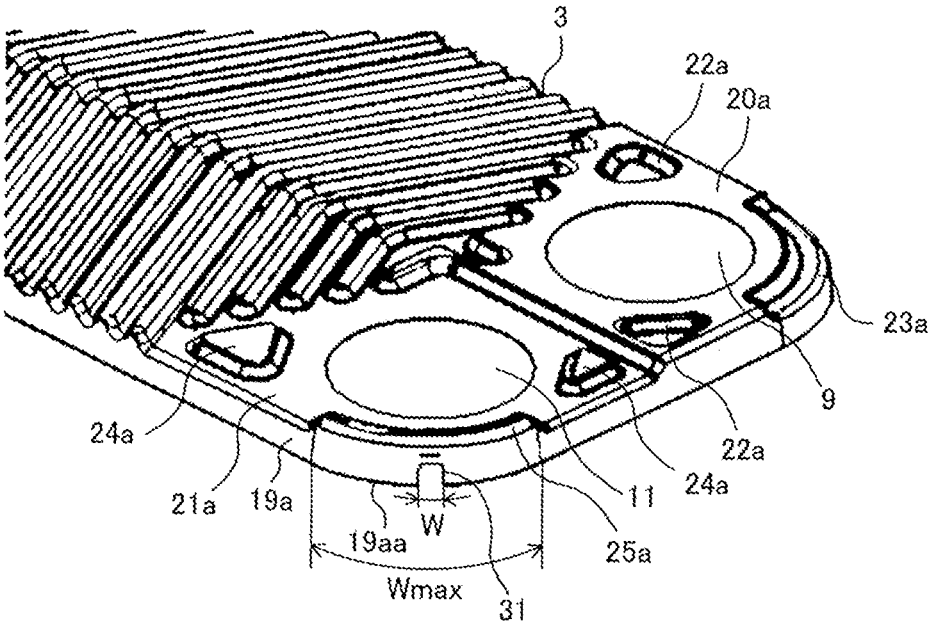
FIG. 11 is an exploded perspective view of the first heat transfer plate 3 and the second heat transfer plate 2 of the plate heat exchanger 40 as viewed from the front, according to Embodiment 1 of the present disclosure.
Figure 11:
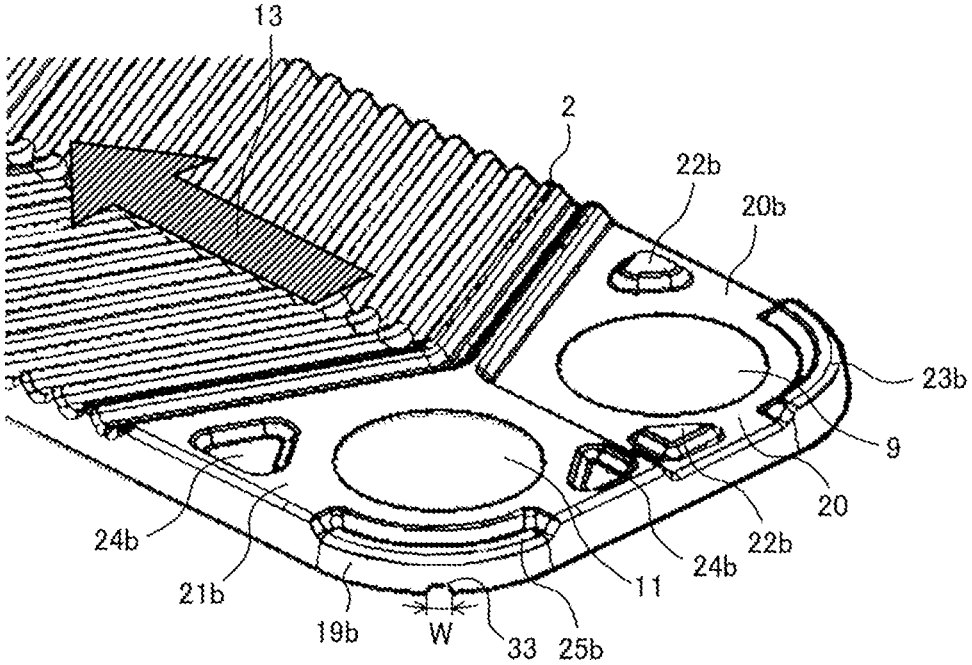
Figure 12:
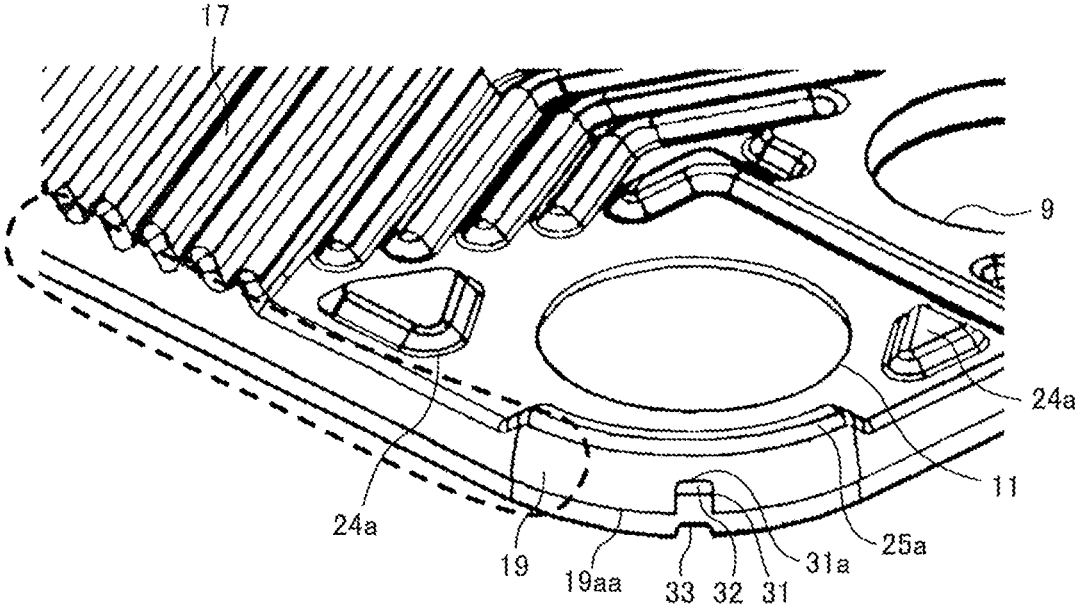
FIG. 12 is a perspective view of a relevant portion in a state where the first heat transfer plate 3 and the second heat transfer plate 2 of the plate heat exchanger 40 are stacked on each other, according to Embodiment 1 of the present disclosure.
Figure 13:
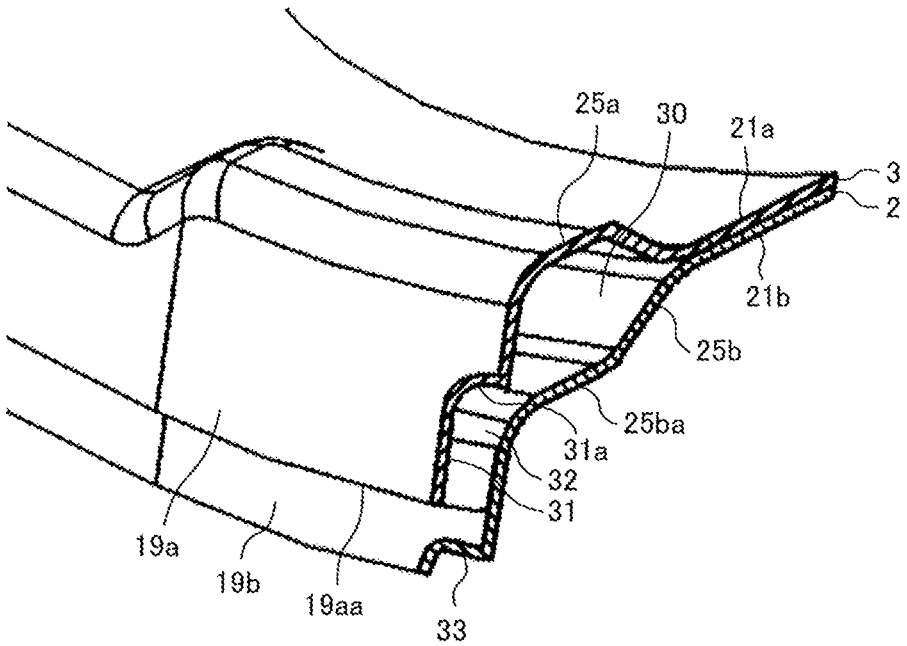
FIG. 13 is a cross-sectional perspective view of a portion where the first heat transfer plate 3 and the second heat transfer plate 2 of the plate heat exchanger 40 are stacked on each other, taken along line B-B illustrated in FIG. 6, according to Embodiment 1 of the present disclosure.
Figure 14:
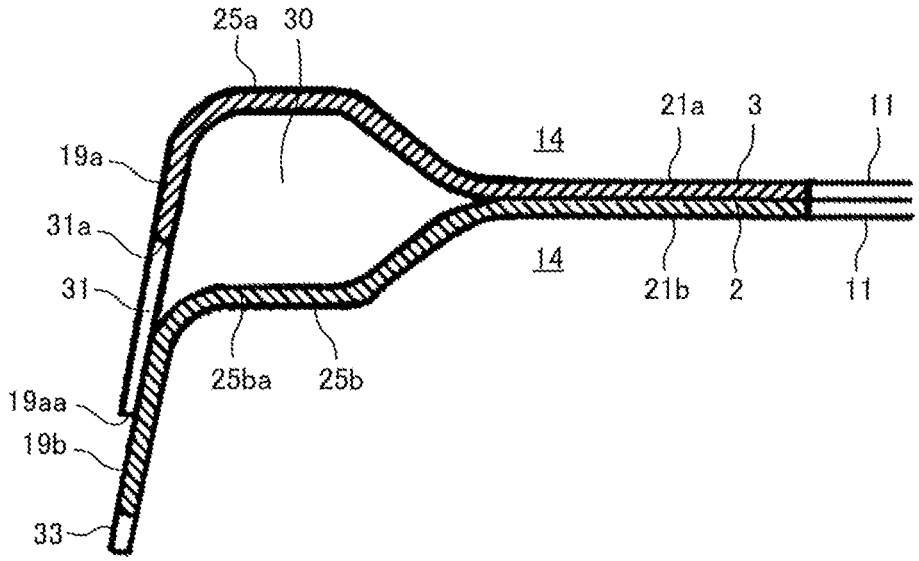
FIG. 14 is an end surface diagram of the cross-section at the position same as the position illustrated in FIG. 13.

FIG. 11 is an exploded perspective view of one first heat transfer plate 3 and one second heat transfer plate 2 of the plate heat exchanger 40 according to Embodiment 1 of the present disclosure as viewed from the front. FIG. 12 is a perspective view of a relevant portion in a state where the first heat transfer plate 3 and the second heat transfer plate 2 of the plate heat exchanger 40 are stacked on each other, according to Embodiment 1 of the present disclosure. FIG. 13 is a cross-sectional perspective view of a portion where the first heat transfer plate 3 and the second heat transfer plate 2 of the plate heat exchanger 40 are stacked on each other, taken along line B-B illustrated in FIG. 6, according to Embodiment 1 of the present disclosure. FIG. 14 is an end surface diagram of the cross-section at the position same as the position illustrated in FIG. 13.

In the convex region 20*a* of the first heat transfer plate 3, a plurality of concave portions recessed downward are provided. More specifically, as the plurality of concave portions, paired concave portions 22*a* each having a triangular shape in a planar view, and an arc-shaped concave portion 23*a* formed at a corner peripheral edge part of the first heat transfer plate 3 are provided. Further, in the concave region 21*a* of the first heat transfer plate 3, a plurality of convex portions projecting upward are provided. More specifically, as the plurality of convex portions, paired convex portions 24*a* each having a triangular shape in a planar view, and an arc-shaped convex portion 25*a* formed at a corner peripheral edge part of the first heat transfer plate 3 are provided. The shape of each of the paired concave portions 22*a* and the paired convex portions 24*a* is illustrative and is not limited to the triangular shape. Each of the paired concave portions 22*a* and the paired convex portions 24*a* may have a square shape, a columnar shape, or other shapes.

In the concave region 20*b* of the second heat transfer plate 2, a plurality of convex portions projecting upward are provided. More specifically, as the plurality of convex portions, paired convex portions 22*b* each having a triangular shape in a planar view, and an arc-shaped convex portion 23*b* formed at a corner peripheral edge part of the second heat transfer plate 2 are provided. Further, in the convex region 21*b* of the second heat transfer plate 2, a plurality of concave portions recessed downward are provided. More specifically, as the plurality of concave portions, paired concave portions 24*b* each having a triangular shape in a planar view, and an arc-shaped concave portion 25*b* formed at a corner peripheral edge part of the second heat transfer plate 2 are provided. The shape of each of the paired convex portions 22*b* and the paired concave portions 24*b* is illustrative and is not limited to the triangular shape. Each of the paired convex portions 22*b* and the paired concave portions 24*b* may have a square shape, a columnar shape, or other shapes.

When the first heat transfer plate 3 and the second heat transfer plate 2 configured as described above are stacked on each other, the paired concave portions 22*a* and the paired convex portions 22*b* are in surface contact with each other, and the concave portion 23*a* and the convex portion 23*b* are in surface contact with each other in the flow path region 20 formed by the convex region 20*a* and the concave region 20*b*. The portions that are in surface contact with each other are brazed to each other and are used as supporting portions withstanding inner pressure of the flow paths, which improves strength of the heat transfer plates.

In contrast, in the non-flow path region 21 formed by the concave region 21*a* and the convex region 21*b*, spaces of the paired convex portions 24*a* and spaces of the paired concave portions 24*b* are stacked on each other in the vertical direction to form paired cavities. In vacuum brazing in a process of manufacturing the plate heat exchanger 40, surroundings of the paired cavities are brazed to each other in a vacuumed state, and the paired cavities become sealed spaces. Further, a space of the convex portion 25*a* and a space of the concave portion 25*b* are stacked on each other in the vertical direction to define a cavity 30 (refer to FIG. 13 and FIG. 14).

Embodiment 1 is characterized in that a communication port 32 through which the cavity 30 communicates with the outside is provided at plate portions defining the cavity 30. A specific configuration of the communication port 32 is described below.

In FIG. 11 and diagrams described below, the outer peripheral flange portion 19 of the first heat transfer plate 3 is referred to as a first outer peripheral flange portion 19*a*, and the outer peripheral flange portion 19 of the second heat transfer plate 2 is referred to as a second outer peripheral flange portion 19*b*, for distinction. As described above, the convex portion 25*a* and the concave portion 25*b* that are the plate portions defining the cavity 30 are provided at the corner peripheral edge parts of the heat transfer plates. As illustrated in FIG. 13 and FIG. 14, a part of the convex portion 25*a* is formed by the first outer peripheral flange portion 19*a*. A lower end part of the first outer peripheral flange portion 19*a* is stacked on an outside portion of the second outer peripheral flange portion 19*b*, and the closed cavity 30 is defined by the convex portion 25*a* and the concave portion 25*b*.

The first outer peripheral flange portion 19*a* has a notch 31 that extends upward from a lower end 19*aa* of the first outer peripheral flange portion 19*a*. A height position of an upper end surface 31*a* of the notch 31 is higher than a height position of a bottom surface 25*ba* of the concave portion 25*b*. Accordingly, as illustrated in FIG. 12, the notch 31 forms the communication port 32 communicating with the cavity 30, and the cavity 30 communicates with the outside through the communication port 32.

When the notch 31 forming the communication port 32 extends up to a top of the convex portion 25*a*, the cavity 30 communicates with the second flow path 14 provided between the first heat transfer plate 3 and the second heat transfer plate 2 stacked on the upper surface of the first heat transfer plate 3. Therefore, the notch 31, in other words, the communication port 32 is provided in only the first outer peripheral flange portion 19*a*. In this example, the communication port 32 through which the cavity 30 communicates with the outside is formed by the notch 31, but may be formed by a through hole.

Next, action of the above-described configuration is described.

The communication port 32 is provided to detect brazing failure before shipment of the plate heat exchanger 40. The brazing failure of the first heat transfer plate 3 and the second heat transfer plate 2 is first described.

Figure 15:
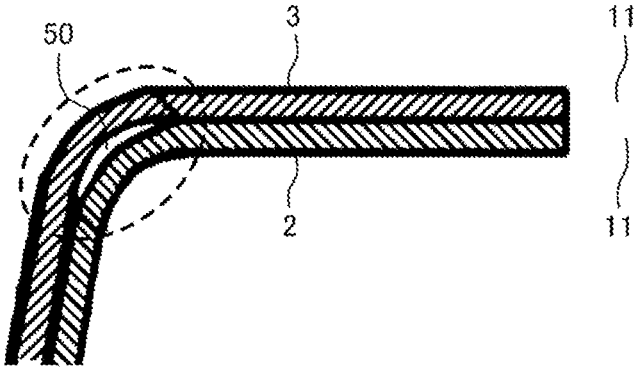
FIG. 15 is a cross-sectional view of an outer peripheral edge portion in the state where the first heat transfer plate 3 and the second heat transfer plate 2 of the plate heat exchanger 40 are stacked on each other, according to Embodiment 1 of the present disclosure.

FIG. 15 is a cross-sectional view of an outer peripheral edge portion in the state where the first heat transfer plate 3 and the second heat transfer plate 2 of the plate heat exchanger 40 are stacked on each other, according to Embodiment 1 of the present disclosure.

In the state where the first heat transfer plate 3 and the second heat transfer plate 2 are stacked on each other, a gap 50 is opened in the outer peripheral edge portion surrounded by a dashed line in the drawing. When a brazing filler metal does not spread over the gap 50 in brazing, brazing failure occurs.

When such brazing failure occurs along an outer peripheral edge of the heat transfer plates as illustrated as a portion surrounded by a dashed line illustrated in FIG. 12, the heat exchange portion 17 and the cavity 30 communicate with each other through a portion where the brazing failure occurs. When the heat exchange portion 17 and the cavity 30 communicate with each other, the water used as the first fluid flows into the cavity 30 from the heat exchange portion 17 through the portion where the brazing failure occurs, and stays in the cavity 30. In the case where the plate heat exchanger 40 is used as an evaporator, when the water stays in the cavity 30, the water staying in the cavity 30 may freeze and expand, which may damage the heat transfer plates.

Therefore, in Embodiment 1, the cavity 30 is defined to communicate with the outside as described above. In the case where the brazing failure making the heat exchange portion 17 and the cavity 30 communicate with each other occurs, it is possible to detect the brazing failure in the following manner in airtightness inspection in a manufacturing stage. In the airtightness inspection, inspection air is supplied from the first inflow port 9 to the first flow path 13. When the heat exchange portion 17 and the cavity 30 communicate with each other because of the brazing failure, the inspection air supplied to the first flow path 13 flows into the cavity 30 through the heat exchange portion 17, and leaks from the communication port 32 to the outside. Therefore, a possible brazing failure is detected by detecting leakage of the inspection air from the communication port 32. Detecting the brazing failure in the above-described manner makes it possible to prevent a defective product from being shipped to a market.

In Embodiment 1, a notch 33 is provided also in the second outer peripheral flange portion 19*b* as illustrated in FIG. 11 to FIG. 13. The notch 33 is a notch through which the communication port 32 of the first heat transfer plate 3 stacked under the second heat transfer plate 2 is exposed and that does not cover the communication port 32. Therefore, when the second outer peripheral flange portion 19*b* of the second heat transfer plate 2 does not cover the communication port 32 in terms of dimensional relationship, the notch 33 may not be provided.

The communication port 32 has a size enabling gas used as the inspection air, such as nitrogen and oxygen, to pass through the communication port 32 at about 0.1 MPaG.

As described above, in Embodiment 1, the plate heat exchanger 40 has the flow paths formed by the spaces among the plurality of heat transfer plates stacked on each other, and each of the heat transfer plates includes the heat exchange portion 17 through which the fluid flowing through the flow paths exchanges heat, and the header portions 18 provided on the respective ends of the heat exchange portion 17 in the fluid flowing direction. When, out of adjacent two in the stacking direction of the heat transfer plates, one heat transfer plate provided in front of the other heat transfer plate is referred to as the first heat transfer plate 3 and the other heat transfer plate provided in rear of the one heat transfer plate is referred to as the second heat transfer plate 2, a header portion 18 of each of the first heat transfer plates 3 and the header portion 18 of a corresponding one of each of the second heat transfer plates 2 partly form the non-flow path region 21 where the header portions 18 are in contact with each other not to allow the fluid to pass through the non-flow path region 21. The peripheral edge part in the non-flow path region 21 of each of the first heat transfer plates 3 includes the convex portion 25*a* projecting upward, and the peripheral edge part in the non-flow path region 21 of each of the second heat transfer plates 2 includes the concave portion 25*b* recessed downward. The convex portion 25*a* and the concave portion 25*b* are stacked on each other in the stacking direction to define the cavity 30, and the communication port 32 through which the cavity 30 communicates with the outside is provided in the plate portions defining the cavity 30.

With this configuration, when the brazing failure occurs, the inspection air leaks from the cavity 30 in the airtightness inspection. Therefore, a possible brazing failure is detected by detecting leakage of the inspection air. As a result, it is possible to prevent a defective product including the brazing failure from being shipped to a market.

In Embodiment 1, each of the first heat transfer plates 3 includes the first outer peripheral flange portion 19*a* on the outer peripheral edge of the first heat transfer plate 3. The first outer peripheral flange portion 19*a* is a part of the convex portion 25*a*, and the communication port 32 is provided at the first outer peripheral flange portion 19*a*.

In this configuration, the communication port 32 is provided in the first outer peripheral flange portion 19*a*, and is not provided at the top of the convex portion 25*a*. Therefore, the cavity 30 does not communicate with the flow path provided on the top surface of the first heat transfer plate 3.

In Embodiment 1, the communication port 32 is formed by the notch 31 or a through hole.

As described above, the communication port 32 is allowed to be formed by the notch 31 or a through hole.

In Embodiment 1, each of the second heat transfer plates 2 includes the second outer peripheral flange portion 19*b* on the outer peripheral edge of the second heat transfer plate 2. The second outer peripheral flange portion 19*b* of each of the second heat transfer plates 2 has the notch 33 through which the communication port 32 of a corresponding one of the first heat transfer plates 3 stacked under each of the second heat transfer plates 2 is exposed.

With this configuration, it is possible to prevent the communication port 32 of each of the first heat transfer plate 3 from being covered with the second outer peripheral flange portion 19*b*.

In Embodiment 1, the passage holes used as the inflow ports and the outflow ports for the first fluid or the second fluid used as the fluid are provided at the four corners of each of the first heat transfer plates 3 each having a rectangular shape and at the four corners of each of the second heat transfer plates 2 each having a rectangular shape. The first flow path 13 through which the first fluid flows and the second flow path 14 through which the second fluid flows are each formed between each of the heat transfer plates 3 and an adjacent one of the heat transfer plates 2, and the first flow paths 13 and the second flow paths 14 are alternately provided among the first heat transfer plates 3 and the second heat transfer plates 2 in the stacking direction. The first flow path 13 is a flow path through which the first fluid flowing from the first inflow port 9 used as the passage hole provided to one end portion of each of the first heat transfer plates 3 and the second heat transfer plates 2 in the long-side direction flows out from the first outflow port 10 used as the passage hole provided to the other end portion in the long-side direction. The second flow path is a flow path through which the second fluid flowing from the second inflow port 11 used as the passage hole provided to one end portion of each of the first heat transfer plates 3 and the second heat transfer plates 2 in the long-side direction flows out from the second outflow port 12 used as the passage hole provided to the other end portion in the long-side direction. The heat exchange portion 17 of each of the first heat transfer plates 3 and the second heat transfer plates 2 is provided with the corrugated portion displaced in the stacking direction.

With this configuration, in a case where the brazing failure occurs in the first flow path 13 through which the first fluid flows, the inspection air leaks from the communication port 32 in airtightness inspection. A possible brazing failure is thus detected by detecting the leakage of the inspection air. As a result, in the case where the first fluid is water, it is possible to prevent a defective product in which damage caused by freezing of the water may occur, from being shipped to a market.

The plate heat exchanger 40 of the present disclosure is not limited to the configuration illustrated in the above-described drawings, and may be configured by being modified, for example, in the following manner without departing from the scope of the present disclosure.

It is sufficient to provide the notch 31 at least on the convex portion 25*a* provided in the non-flow path region 21 of the two heat transfer plates forming the flow path through which the water flows, and the notches 31 may be further provided at a plurality of positions. For example, when the notch 31 is provided at one position, the direction of each of the heat transfer plates stacked on the other heat transfer plate is limited. Therefore, the notch 31 may be provided on each of four corner peripheral edge parts. Likewise, the position of the notch 33 is not limited to one position, and the notches 33 may be provided at a plurality of positions.

In the above-described plate heat exchanger 40, the convex portion 25*a* and the concave portion 25*b* defining the cavity 30 are provided at the corner peripheral edge parts; however, the positions of the convex portion 25*a* and the concave portion 25*b* are not limited to the corner peripheral edge parts as long as the convex portion 25*a* and the concave portion 25*b* are provided on the peripheral edge parts of the header portions 18.

In the above-described plate heat exchanger 40, the heat transfer plates 2 and the heat transfer plates 3 are stacked on each other; however, the heat transfer plates 2 and the heat transfer plates 2 turned upside down may be stacked on each other, or the heat transfer plates 3 and the heat transfer plates 3 turned upside down may be stacked on each other. When the same heat transfer plates are used by being turned upside down, it is possible to standardize specification of parts; which makes it possible to reduce its cost.

Embodiment 2

In Embodiment 2, an example of a circuit configuration of a heat pump apparatus 100 using the plate heat exchanger 40 is described.

In the heat pump apparatus 100, for example, $CO_2$, R410A, or HC is used as the refrigerant as described above. Whereas some refrigerant, such as $CO_2$, has high pressure that reaches a supercritical range, a case where R410A is used as the refrigerant is described as an example.

Figure 16:
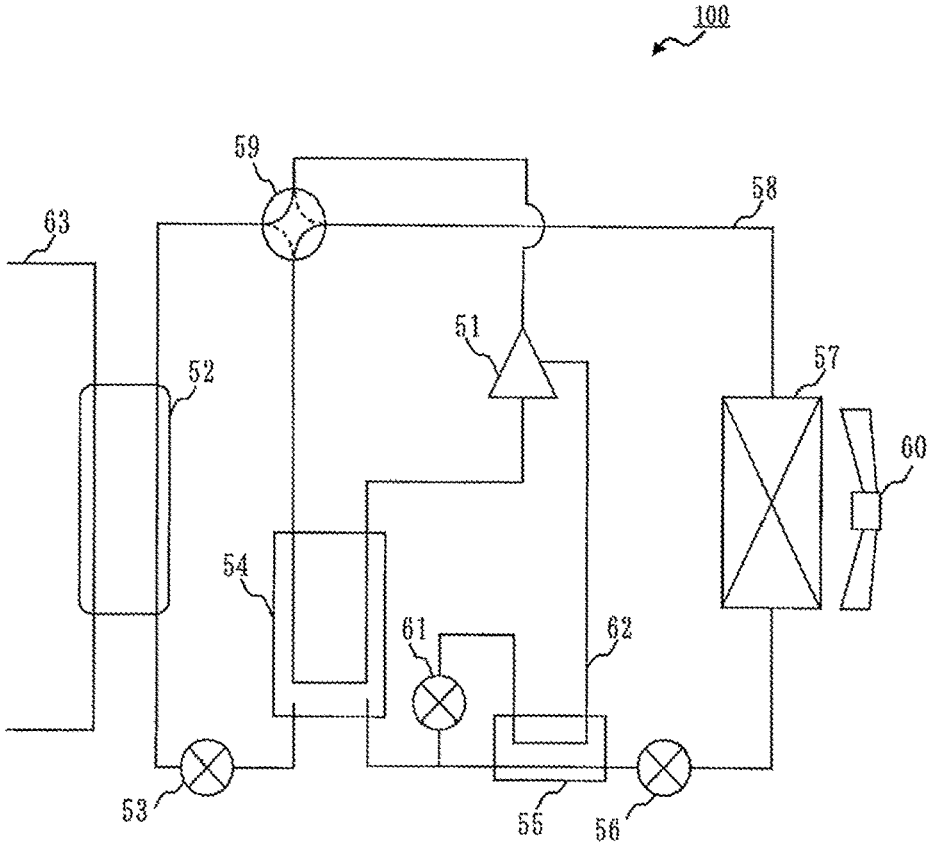
FIG. 16 is a circuit configuration diagram of a heat pump apparatus 100 according to Embodiment 2 of the present disclosure.
Figure 17:
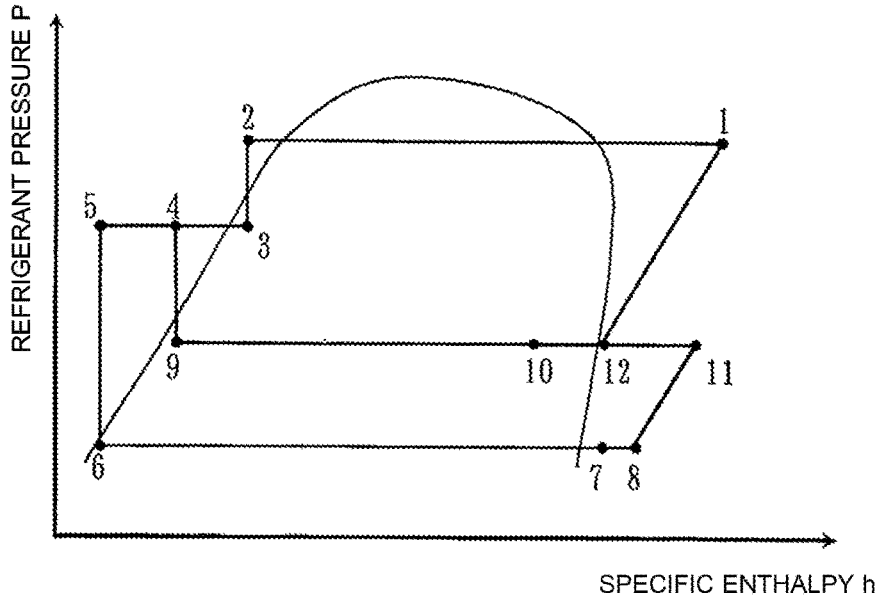
FIG. 17 is a Mollier diagram illustrating a state of refrigerant in the heat pump apparatus 100 illustrated in FIG. 16.

FIG. 16 is a circuit configuration diagram of the heat pump apparatus 100 according to Embodiment 2 of the present disclosure. FIG. 17 is a Mollier diagram illustrating a state of the refrigerant in the heat pump apparatus 100 illustrated in FIG. 16. In FIG. 17, a horizontal axis represents a specific enthalpy, and a vertical axis represents refrigerant pressure.

The heat pump apparatus 100 includes a main refrigerant circuit 58 in which a compressor 51, a heat exchanger 52, an expansion mechanism 53, a receiver 54, an internal heat exchanger 55, an expansion mechanism 56, and a heat exchanger 57 are sequentially connected by pipes, and through which refrigerant circulates. In the main refrigerant circuit 58, a four-way valve 59 is provided to a discharge port of the compressor 51, and a refrigerant circulation direction is switchable. Further, a fan 60 is provided close to the heat exchanger 57. The plate heat exchanger 40 described in the above-described embodiment is used as the heat exchanger 52.

The heat pump apparatus 100 further includes an injection circuit 62 that connects a position between the receiver 54 and the internal heat exchanger 55 to an injection pipe of the compressor 51 by pipes. The expansion mechanism 61 and the internal heat exchanger 55 are sequentially connected to the injection circuit 62.

A water circuit 63 through which water circulates is connected to the heat exchanger 52. Note that a device using water, such as a water heater, a radiator, and a radiator for a floor heating is connected to the water circuit 63.

First, operation of the heat pump apparatus 100 during heating operation is described. During the heating operation, the four-way valve 59 is set to directions illustrated by solid lines. The heating operation includes not only heating used for air conditioning but also water heating in which heat is applied to the water to make hot water.

Refrigerant that is turned into high-temperature and high-pressure gas-phase refrigerant by the compressor 51 (point 1 illustrated in FIG. 17) is discharged from the compressor 51, exchanges heat in the heat exchanger 52 used as a condenser and a radiator, and is liquefied (point 2 illustrated in FIG. 17). At this time, the water circulating through the water circuit 63 is heated by heat radiated from the refrigerant, and the heated water is used for air heating or water heating.

The liquid-phase refrigerant liquefied in the heat exchanger 52 is decompressed by the expansion mechanism 53, and is thus turned into two-phase gas-liquid refrigerant (point 3 illustrated in FIG. 17). The two-phase gas-liquid refrigerant obtained in the expansion mechanism 53 exchanges, in the receiver 54, heat with the refrigerant to be suctioned into the compressor 51, and is cooled and liquefied (point 4 illustrated in FIG. 17). The liquid-phase refrigerant liquefied by the receiver 54 is distributed into and flows through the main refrigerant circuit 58 and the injection circuit 62.

The liquid-phase refrigerant flowing through the main refrigerant circuit 58 exchanges, in the internal heat exchanger 55, heat with the two-phase gas-liquid refrigerant that has been decompressed by the expansion mechanism 61 and flows through the injection circuit 62, and is further cooled (point 5 illustrated in FIG. 17). The liquid-phase refrigerant cooled in the internal heat exchanger 55 is decompressed by the expansion mechanism 56, and is thus turned into the two-phase gas-liquid refrigerant (point 6 illustrated in FIG. 17). The two-phase gas-liquid refrigerant obtained in the expansion mechanism 56 exchanges heat with outside air in the heat exchanger 57 used as an evaporator, and is heated (point 7 illustrated in FIG. 17). Subsequently, the refrigerant heated in the heat exchanger 57 is further heated by the receiver 54 (point 8 illustrated in FIG. 17), and is suctioned into the compressor 51.

In contrast, the refrigerant flowing through the injection circuit 62 is decompressed by the expansion mechanism 61 as described above (point 9 illustrated in FIG. 17), and exchanges heat in the internal heat exchanger 55 (point 10 illustrated in FIG. 17). The two-phase gas-liquid refrigerant (injection refrigerant) having exchanged heat in the internal heat exchanger 55 remains in the two-phase gas-liquid state and flows into the compressor 51 from the injection pipe of the compressor 51.

In the compressor 51, the refrigerant suctioned from the main refrigerant circuit 58 (point 8 illustrated in FIG. 17) is compressed to intermediate pressure and is heated (point 11 illustrated in FIG. 17). The injection refrigerant (point 10 illustrated in FIG. 17) merges with the refrigerant compressed to the intermediate pressure and heated (point 11 illustrated in FIG. 17). As a result, temperature of the refrigerant is lowered (point 12 illustrated in FIG. 17). Further, the refrigerant lowered in temperature (point 12 illustrated in FIG. 17) is further compressed and heated, and is thus turned into high-temperature high-pressure refrigerant. The high-temperature high-pressure refrigerant is discharged (point 1 illustrated in FIG. 17).

In a case where injection operation is not performed, the expansion mechanism 61 is set to a fully-closed opening degree. More specifically, in the case where the injection operation is performed, the opening degree of the expansion mechanism 61 is greater than a predetermined opening degree, whereas in the case where the injection operation is not performed, the opening degree of the expansion mechanism 61 is made smaller than the predetermined opening degree. As a result, the refrigerant does not flow into the injection pipe of the compressor 51.

The opening degree of the expansion mechanism 61 is electronically controlled by a controller such as a microcomputer.

Next, operation of the heat pump apparatus 100 during cooling operation is described. During the cooling operation, the four-way valve 59 is set to directions illustrated by dashed lines. The cooling operation includes not only cooling used for air conditioning but also cooling to make cold water by removing heat from the water, refrigeration, and other usage.

Refrigerant that is turned into high-temperature and high-pressure gas-phase refrigerant by the compressor 51 (point 1 illustrated in FIG. 17) is discharged from the compressor 51, exchanges heat in the heat exchanger 57 used as a condenser and a radiator, and is liquefied (point 2 illustrated in FIG. 17), The liquid-phase refrigerant liquefied in the heat exchanger 57 is decompressed by the expansion mechanism 56, and is thus turned into the two-phase gas-liquid refrigerant (point 3 illustrated in FIG. 17). The two-phase gas-liquid refrigerant obtained in the expansion mechanism 56 exchanges heat in the internal heat exchanger 55, and is cooled and liquefied (point 4 illustrated in FIG. 1). The internal heat exchanger 55 exchanges heat between the two-phase gas-liquid refrigerant obtained in the expansion mechanism 56 and the two-phase gas-liquid refrigerant that is obtained by decompressing, in the expansion mechanism 61, the liquid-phase refrigerant liquefied in the internal heat exchanger 55 (point 9 illustrated in FIG. 17). The liquid-phase refrigerant having exchanged heat in the internal heat exchanger 55 (point 4 illustrated in FIG. 17) is distributed into and flows through the main refrigerant circuit 58 and the injection circuit 62.

The liquid-phase refrigerant flowing through the main refrigerant circuit 58 exchanges, in the receiver 54, heat with the refrigerant to be suctioned into the compressor 51, and is further cooled (point 5 illustrated in FIG. 17). The liquid-phase refrigerant cooled by the receiver 54 is decompressed by the expansion mechanism 53, and is thus turned into the two-phase gas-liquid refrigerant (point 6 illustrated in FIG. 17). The two-phase gas-liquid refrigerant obtained in the expansion mechanism 53 exchanges heat in the heat exchanger 52 used as an evaporator, and is heated (point 7 illustrated in FIG. 17). At this time, the refrigerant receives heat to cool the water circulating through the water circuit 63, and the cold water is used for air cooling or refrigeration.

Further, the refrigerant heated in the heat exchanger 52 is further heated by the receiver 54 (point 8 illustrated in FIG. 17), and is suctioned into the compressor 51.

In contrast, the refrigerant flowing through the injection circuit 62 is decompressed by the expansion mechanism 61 as described above (point 9 illustrated in FIG. 17), and exchanges heat in the internal heat exchanger 55 (point 10 illustrated in FIG. 17). The two-phase gas-liquid refrigerant (injection refrigerant) having exchanged heat in the internal heat exchanger 55 remains in the two-phase gas-liquid state and flows into the compressor 51 from the injection pipe of the compressor 51.

Compression operation inside the compressor 51 is similar to the compression operation during the heating operation.

In the case where the injection operation is not performed, the expansion mechanism 61 is set to the fully-closed opening degree as in the heating operation, to prevent the refrigerant from flowing into the injection pipe of the compressor 51.

As the heat pump apparatus of Embodiment 2 includes the plate heat exchanger 40 of Embodiment 1, possible brazing failure in the plate heat exchanger 40 is detected in airtightness inspection before shipment.

In Embodiment 2, the description is given in a case where the heat pump apparatus is an air-conditioning apparatus performing the cooling operation and the heating operation; however, the heat pump apparatus may be, for example, a cooling device cooling a freezing refrigerating warehouse, or a water heating device.

REFERENCE SIGNS LIST

1: reinforcing side plate, 2: heat transfer plate (second heat transfer plate), 3: heat transfer plate (first heat transfer plate), 4: reinforcing side plate, 5: first inflow pipe, 6: first outflow pipe, 7: second inflow pipe, 8: second outflow pipe, 9: first inflow port, 10: first outflow port, 11: second inflow port, 12: second outflow port, 13: first flow path, 14: second flow path, 15: corrugated portion, 16: corrugated portion, 17: heat exchange portion, 18: header portion, 19: outer peripheral flange portion, 19*a*: first outer peripheral flange portion, 19*aa*: lower end, 19*b*: second outer peripheral flange portion, 20: flow path region, 20*a*: convex region, 20*b*: concave region, 21: non-flow path region, 21*a*: concave region, 21*b*: convex region, 22*a*: concave portion, 22*b*: convex portion, 23*a*: concave portion, 23*b*: convex portion, 24*a*: convex portion, 24*b*: concave portion, 25*a*: convex portion, 25*b*: concave portion, 25*ba*: bottom surface, 30: cavity, 31: notch, 31*a*: upper end surface, 32: communication port, 33: notch, 40: plate heat exchanger, 50: gap, 51: compressor, 52: heat exchanger, 53: expansion mechanism, 54: receiver, 55: internal heat exchanger, 56: expansion mechanism, 57: heat exchanger, 58: main refrigerant circuit, 59: four-way valve, 60: fan, 61: expansion mechanism, 62: injection circuit, 63: water circuit, 100: heat pump apparatus

The invention claimed is:

1. A plate heat exchanger having flow paths formed by spaces among a plurality of heat transfer plates stacked on each other, when, out of adjacent two in a stacking direction of the plurality of heat transfer plates, one heat transfer plate provided in front of an other heat transfer plate is referred to as a first heat transfer plate and the other heat transfer plate provided in rear of the one heat transfer plate is referred to as a second heat transfer plate, the first heat transfer plates and the second heat transfer plates being alternately stacked on each other, each of the first heat transfer plates and the second heat transfer plates including a heat exchange portion and header portions, fluid flowing through the flow paths exchanges heat through the heat exchange portion, the header portions being provided on respective ends of the heat exchange portion in a flowing direction of the fluid, a header portion of each of the first heat transfer plates and a corresponding header portion of each of the second heat transfer plates partly form a non-flow path region where the header portions are in contact with each other and brazed to each other not to allow the fluid to pass through the non-flow path region, an outer peripheral edge part in the non-flow path region of each of the first heat transfer plates including a convex portion projecting upward, an outer peripheral edge part in the non-flow path region of each of the second heat transfer plates including a concave portion recessed downward, a space of the convex portion of each of the first heat transfer plates and a space of the concave portion of a corresponding one of the second heat transfer plates being stacked on each other in the stacking direction to define a cavity, a communication port being provided at plate portions defining the cavity, the communication port of each of the cavities being an opening through which the cavity communicates with an outside of the heat exchanger, the communication port being a port open directly to the outside and through which the heat exchange portion communicates directly with the outside when the cavity and the heat exchange portion communicate with each other through a portion where brazing failure occurs.

2. The plate heat exchanger of claim 1, wherein each of the first heat transfer plates includes a first outer peripheral flange portion on an outer peripheral edge of the first heat transfer plate, and the first outer peripheral flange portion is a part of the convex portion, the communication port being provided at the first outer peripheral flange portion.

3. The plate heat exchanger of claim 1, wherein the communication port is a notch or a through hole.

4. The plate heat exchanger of claim 1, wherein each of the second heat transfer plates includes a second outer peripheral flange portion on an outer peripheral edge of the second heat transfer plate, and the second outer peripheral flange portion has a notch through which the communication port of a corresponding one of the first heat transfer plates stacked under each of the second heat transfer plates is exposed.

5. The plate heat exchanger of claim 1, wherein passage holes used as inflow ports and outflow ports for first fluid or second fluid used as the fluid are provided at four corners of each of the first heat transfer plates each having a rectangular shape and at four corners of each of the second heat transfer plates each having a rectangular shape, a first flow path through which the first fluid flows and a second flow path through which the second fluid flows are each formed between each of the first heat transfer plates and an adjacent one of the second heat transfer plates, and the first flow paths and the second flow paths are alternately provided among the first heat transfer plates and the second heat transfer plates in the stacking direction, the first flow path is a flow path through which the first fluid flowing from a first inflow port used as the passage hole provided to one end portion of each of the first heat transfer plates and the second heat transfer plates in a long-side direction flows out from a first outflow port used as the passage hole provided to an other end portion in the long-side direction, the second flow path is a flow path through which the second fluid flowing from a second inflow port used as the passage hole provided to one end portion of each of the first heat transfer plates and the second heat transfer plates in the long-side direction flows out from a second outflow port used as the passage hole provided to an other end portion in the long-side direction, and the heat exchange portion of each of the first heat transfer plates and the second heat transfer plates is provided with a corrugated portion having a corrugated concave-convex shape.

6. The plate heat exchanger of claim 1, the communication port of each of the cavities being configured as an opening through which the cavity communicates in a surface direction of the heat transfer plates directly with the outside of the heat exchanger.

7. A heat pump apparatus comprising the plate heat exchanger of claim 1.

* * * * *